United States Patent [19]

Dinsmore et al.

[11] Patent Number: 4,693,537

[45] Date of Patent: Sep. 15, 1987

[54] ELECTRICAL CONNECTOR

[75] Inventors: Jeffrey P. Dinsmore; George B. Pfeffer, both of Minnetonka, Minn.

[73] Assignee: ADC Telecommunications, Inc., Minneapolis, Minn.

[21] Appl. No.: 882,530

[22] Filed: Jul. 7, 1986

[51] Int. Cl.[4] ..... H01R 4/24

[52] U.S. Cl. ..... 439/399; 439/404

[58] Field of Search ..... 339/97 R, 97 P, 98, 339/99 R

[56] References Cited

U.S. PATENT DOCUMENTS 4,208,083 6/1980 Kirby ..... 339/97 P 4,614,399 9/1986 Temra et al. ..... 339/97 P

*Primary Examiner*—Joseph H. McGlynn

*Attorney, Agent, or Firm*—Merchant, Gould, Smith, Edell, Welter & Schmidt

[57] ABSTRACT

An electrical connector apparatus (10) is described having a housing with a first end (12) for releasably receiving a terminal end (200) of a jack and a second end (14) for receiving a twisted pair cable (300) having a pair of conductors (301, 302). The housing includes first and second intermediate electrical connectors (70, 80) having first ends (74, 84) for electrically contacting first and second exposed electrical contacts (206, 208) of the terminal end (200) when the terminal end (200) is secured to the housing in predetermined alignment. The first and second intermediate electrical connectors (70, 80) also include second ends (76, 86) having insulation displacement connectors (110) for providing electrical connection between insulation clad conductors (301, 302) of said twisted pair cable (300). Circuit elements (96, 97) are provided within the housing to provide for an electrical circuit between the first and second intermediate electrical connectors (70, 80) for providing compatible electrical connection between the jack and the twisted pair cable.

13 Claims, 18 Drawing Figures

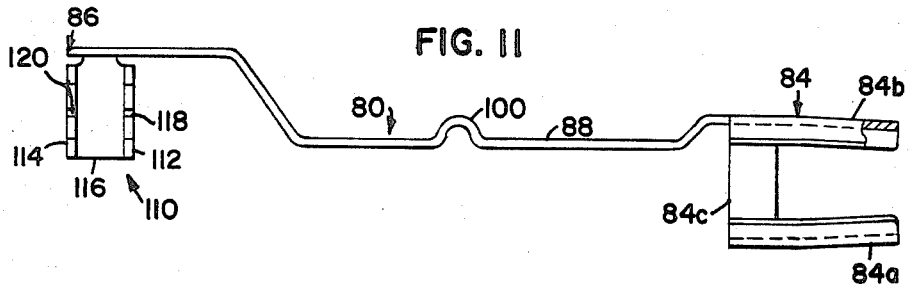
FIG. 11
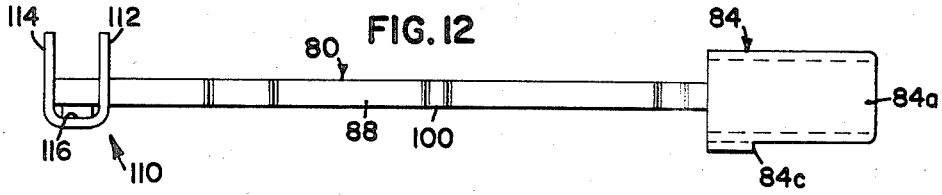
FIG. 12
FIG. 14
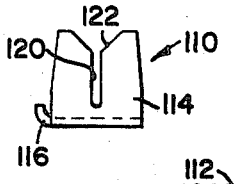
FIG. 13
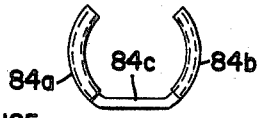
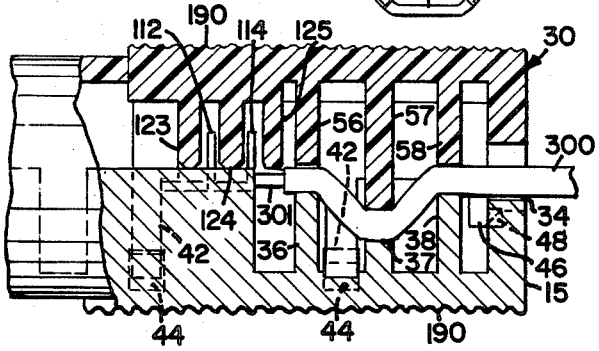
FIG. 15

ELECTRICAL CONNECTOR

BACKGROUND OF THE INVENTION

I. Field of the Invention

This invention pertains to apparatus for effecting electrical connection between two sets of conductors. More particularly, this invention pertains to a connector apparatus for electrically connecting a twisted pair cable to a jack of known construction.

II. Description of the Prior Art

In the prior art, twisted pair cables are widely used as electrical conductors. On occasion, it is desirable to perform an electrical connection between a twisted pair cable and a jack. To accomplish this connection, apparatus must be provided to effectively connect the cable conductors to the jack and (in some instances) to provide necessary circuitry to effect the electrical connection. One function of such circuitry is to provide impedance matching between the twisted pair cable and the circuitry to which the jack is connected.

In the prior art, jacks having terminal ends of known construction are in wide use. An example of such a standardized terminal end is a BNC innerface manufactured according to United States Military specification MIL-C-39012. Another example of such a jack is shown in commonly assigned and copending U.S. patent application Ser. No. 668,752, filed Nov. 16, 1984. These standard terminal ends are bayonet-type terminations. Such a terminal end includes a hollow outer cylindrical member having a pair of diametrically opposed posts extending radially away from the outer surface of the outer cylinder member. A first exposed electrical contact is disposed within the outer cylindrical member and is housed within a hollow inner cylindrical insulator secured within the outer cylinder member and coaxially aligned therewith. Contact with the first exposed contact may be accomplished by inserting a rod-shaped conductor of predetermined size within the insulative inner cylinder. The terminal end is also provided with a second exposed electrical contact disposed within the outer cylinder member exterior of the inner cylindrical insulated member. Commonly, the second contacts include resilient metallic arms which are biased to engage an inner cylindrical surface of the outer cylindrical member.

To effect electrical connection with the exposed contacts of the terminal end, the prior art has developed mating connectors which include first and second contacts sized and aligned to engage the first and second exposed contacts of the terminal end when the terminal end and mating connector are joined together. The mating element typically includes a cylinder of insulative material sized to be received within the outer cylindrical member of the terminal end between the arms of the second exposed contacts and the outer cylindrical member. Accordingly, the insulating cylinder will break electrical connection between the arms and the outer cylinder of the terminal end by urging the arms against their natural resiliency away from the inner wall of the terminal end outer cylinder. Contacts within the insulating cylinder of the mating element contact the second exposed contacts in electrical connection. The mating element also includes an axially extending post of electrically conductive material which is disposed to be received within the hollow insulating inner cylinder of the terminal end to provide electrical connection with the first exposed contact of the terminal end.

Prior art apparatus for effecting electrical connection between such terminal ends and twisted pair cables are expensive to manufacture and cumbersome to use. It is desired to provide such a connector apparatus which is inexpensive and facilitates rapid connection of the jack terminal end and the twisted pair cable. However, the art has not yet developed such an ideal connector.

OBJECTS AND SUMMARY OF THE INVENTION

It is an object of the present invention to provide an electrical connector apparatus for electrically connecting a twisted pair cable to the terminal end of the jack.

A further object of the present invention is to provide an electrical connector apparatus for facilitating rapid electrical connection between a jack and a twisted pair cable.

A yet further object of the present invention is to provide an electrical connector apparatus for connecting a twisted pair cable and a jack and having circuit elements for providing a desired circuit between the jack and the twisted pair cable.

According to a preferred embodiment of the present invention, an electrical connector apparatus is provided comprising a housing having a first end for releasably receiving the terminal end of a jack and a second end for receiving a twisted pair cable having a pair of insulation clad electrical conductors. The apparatus has means for releasably connectig the terminal end to the housing first end to maintain the housing and the terminal end in predetermined alignment. First and second intermediate electrical connectors are carried within the housing with the first electrical connector having a first end disposed to contact a first exposed electrical contact of the terminal end when the terminal end and housing are connected. The second intermediate electrical connector has a first end which is disposed to contact a second exposed contact of the terminal end when the terminal end and housing are connected. Each of the first and second intermediate electrical connectors have second ends with means for electrically connecting the second ends to first and second insulation clad conductors of the twisted pair cable. Circuit elements are provided within the housing having electrical contacts providing a completed circuit between the intermediate electrical connectors.

BRIEF DESCRIPTION OF THE DRAWINGS

FIG. 11 is a top plan view of an intermediate connector of the present invention;

FIG. 12 is a side elevation view of the connector of FIG. 11;

FIG. 13 is a end elevation view of a first end of the connector of FIG. 11;

FIG. 14 is an end elevation view of a second end of the connector of FIG. 11;

FIG. 15 is a view, partially in section, of a second end of the apparatus showing an installed twisted pair cable;

DESCRIPTION OF THE PREFERRED EMBODIMENT

Figure 16:
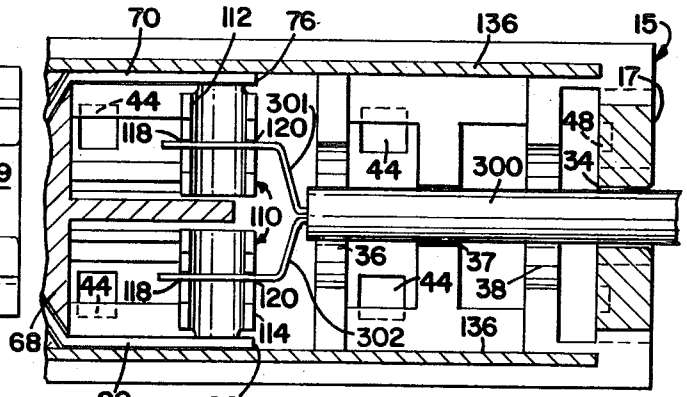
FIG. 16 is a plan view of the second end of the apparatus showing an installed twisted pair cable.

In the several figures in which like elements are identically numbered throughout, an electrical connector apparatus 10 is shown for connecting a twisted pair cable to jack having a terminal end of known construction. In the preferred embodiment, the apparatus is provided for connecting a pair of insulation clad conductors 301, 302 joined in a common twisted pair cable 300 (shown in FIGS. 15 and 16) to a end 200 (shown in FIGS. 17 and 18) of jack such as that shown in commonly assigned U.S. patent application Ser. No. 668,752.

Figure 17:
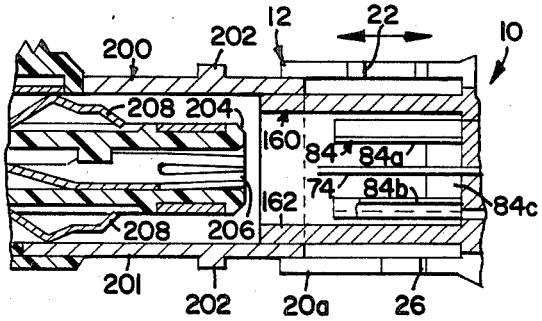
FIG. 17 is a sectorial view of a first end of the apparatus of the present invention aligned with a disconnected terminal end.
Figure 18:
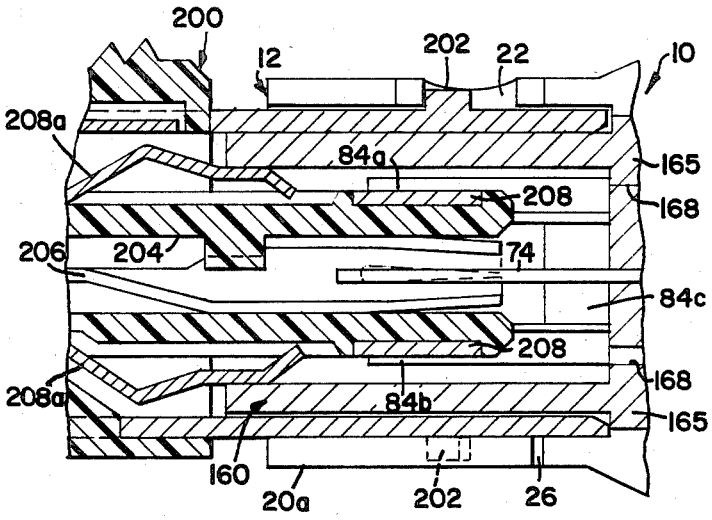
FIG. 18 is a sectional view of the first end of the apparatus of the invention showing a connected terminal end.

A terminal end is shown in FIGS. 17 and 18. The terminal end 200 includes an outer hollow metal cylinder 201 of predetermined dimensions having a pair of diametrically opposed posts 202 projecting radially away from outer surfaces of the metal cylinder. An inner hollow cylinder 204 of insulative material is disposed within the hollow metal cylinder and coaxially aligned therewith. A first exposed electrical contact 206 is disposed within the hollow insulative cylinder 204. A pair of electrically connected second exposed electrical contacts 208 are disposed within the metal cylinder on diametrically opposed sides of the insulative cylinder. The second electrical contacts 208 included electrically connected conductive arms 208*a* which are provided with a natural bias urging the arms 208*a* into electrical contact with the inner surface of the metal cylinder 201.

Figure 2:
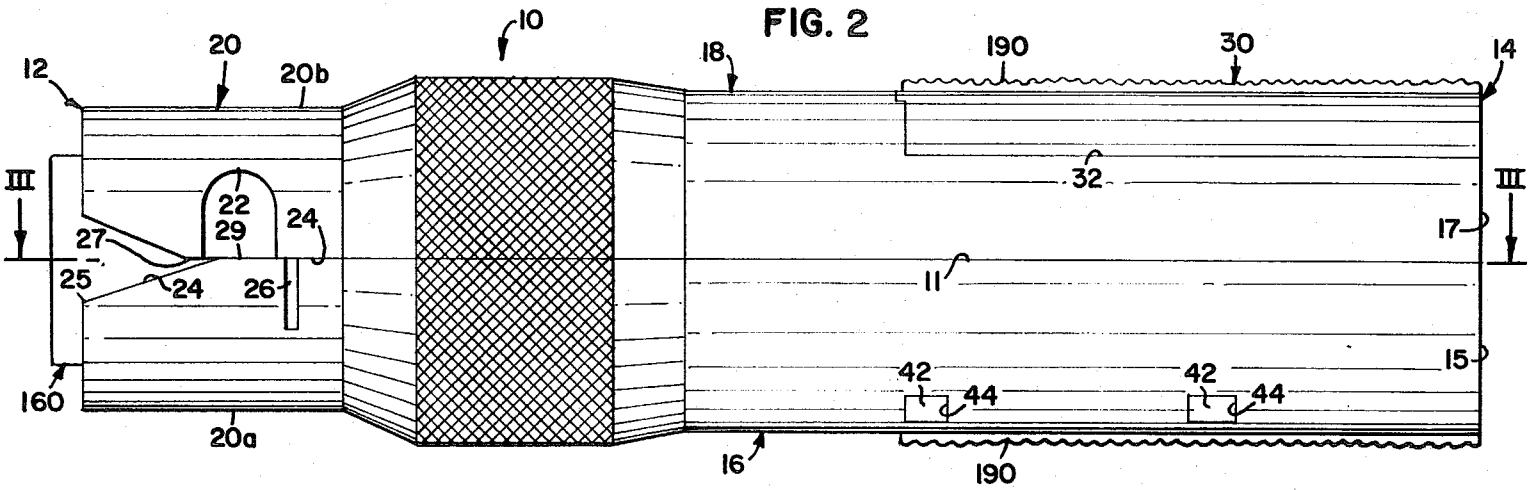
FIG. 2 is a side view taken in elevation of an assembled connector apparatus of the present invention.

To provide electrical connection between the terminal end 200 as described and the insulation clad conductors 301, 302 of the twisted pair cable 300, the electrical connector apparatus 10 of the present invention is provided. As shown in FIG. 2, the apparatus 10 is generally cylindrical in shape and is split at a part line 11 along a longitudinal axis extending from a first end 12 to a second end 14 thereby separating the apparatus 10 into a first generally semi-cylindrical housing portion 16 and a second generally semi-cylindrical housing portion 18.

Apparatus 10 includes a connecting means at first end 12. The connecting means of the apparatus 10 is a generally cylindrical sleeve 20 formed by cooperating first cylindrical half 20*a* of first housing component 16 and second semi-cylindrical half 20*b* of second housing component 18. Sleeve 20 has an inner cylindrical surface sized to slidably receive the outer cylindrical surface of the metal cylinder 201 of the terminal end 200. Sleeve halves 20*a* and 20*b* are symmetrical and are each provided with circumferentially extending pockets 22 sized and aligned to receive the dimetrically opposed posts 202 of the terminal end 200 when the terminal end 200 and the apparatus 10 are in predetermined alignment. In this position, the metal cylinder 201 of the terminal end will be coaxially received within sleeve 20.

Opposing surfaces of the sleeve halves 20*a* and 20*b* define a pair of diametrically opposed axially extending slits 24. As shown in FIG. 2, at first end 12, the slits 24 are sized to present an opening 25 greater than the diameter of the posts 202 of the terminal end 200. The opening of the slits 24 narrow to a point 27 adjacent pocket 22 on a side thereof in common with first end 12. The width of the slits 24 at the point 27 is smaller than the diameter of the terminal end posts 202. The slits 24 extend from end 12 past pockets 22 and are disposed in communication with pockets 22. A circumferential slit 26 is formed in each of sleeve halves 20*a* and 20*b* on sides of pockets 22 opposite end 12. Slits 26 are in communication with slits 24 and extend circumferentially away from an opposing sleeve half. Housing components 16 and 18 are formed of generally resilient material such as plastic. As a result, when a terminal end is inserted within end 12, the posts 202 are guided by the enlarged opening 25 of slits 24 toward narrow slit opening 27. At narrow slit opening 27, the posts 202 are urged toward pockets 22. The urging of the posts toward pockets 22 causes a flap portion 29 of the sleeve halves 20*a* and 20*b* to flex away. Flexing movement of the flaps 27 is accommodated by circumferential slits 26. As the posts 202 move into pocket areas 22, flaps 29 flex back to their relaxed state capturing posts 202 within pockets 22. With the posts within pocket 22, the terminal end 200 and the apparatus 10 are in predetermined alignment. To release the terminal end 200, the end 200 is turned to urge posts 202 to flex flap 29 whereby the end 200 and posts 202 may be moved axially away from apparatus 10.

As shown in FIG. 2, an insertable cap 30 is provided and sized to cover an opening 32 formed adjacent second end 14 of housing component 18. With cap 30 removed, opening 32 exposes a strain relief mechanism within housing component 16 for receiving and capturing a twisted pair cable.

With reference to FIGS. 3, 8–10, 15 and 16, the strain relief mechanism includes a plurality of cable receiving platforms 36, 37, 38 formed in housing components 16. At second end 14, both housing component 16 is provided with a semi-circular opening 34. Component 18 has an corresponding arcuate end portion 35. Also, cap 30 has an arcuate end portion 39. When components 16 and 18 are joined and cap 30 is installed, semi-circular opening 34 cooperate and portion 35 and 39 to define a circular opening through end 14 sized to receive a twisted pair cable 300 of predetermined size. Within housing component 16 and exposed by opening 32 are the three cable receiving platforms 36–38. Each of platforms 36–38 have a concave semi-circular surface opposing opening 32. The semi-circular surfaces of platforms 36–38 are spaced from the part line 11 which defines a generally flat plane extending longitudinally through the apparatus 10 and separating components 16 and 18. Best shown in FIGS. 4 and 15, surfaces 36 and 38 are equally spaced from the part line 11. Surface 37 is disposed between surfaces 36 and 38 and is spaced from part line 11 a distance greater than that of the surfaces 36 and 38.

Figure 10:
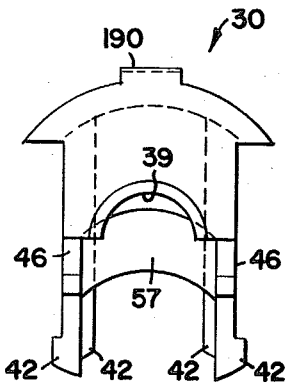
FIG. 10 is an end elevation view of the cap of FIG. 8.
Figure 8:
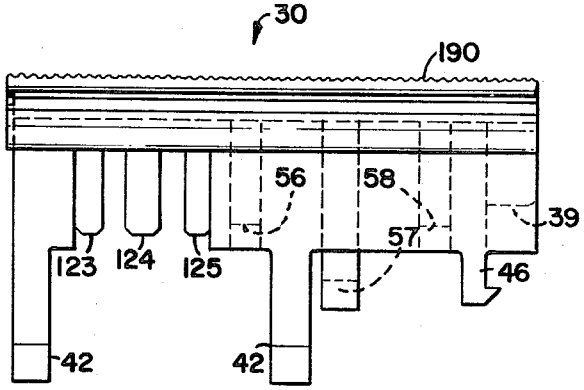
FIG. 8 is a side view taken in elevation of a cap element for the apparatus of the present invention.
Figure 9:
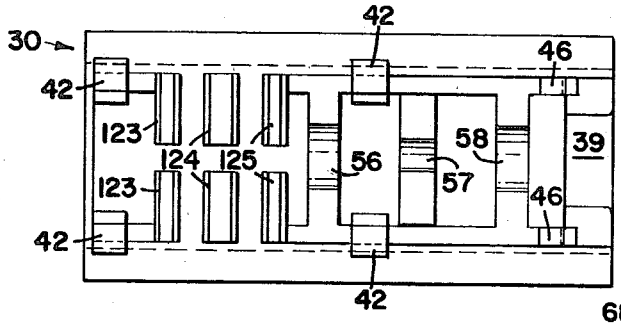
FIG. 9 is a bottom plan view of the cap of FIG. 8.

Shown in FIGS. 8–10, cap 30 is provided with four barbs 42 aligned with barb receiving openings 44 formed in housing component 16. Likewise, cap 30 has a pair of end barbs 46 aligned with barb receiving notches 48 formed in the end wall 15 of housing component 16. With barbs 42 aligned with openings 44 and barbs 46 aligned with notches 48, cap 30 is secured to the apparatus 10 covering opening 32 with the barbs 42 and 46 fixedly secured within openings 44 and 48.

With cap 30 so aligned to have barbs 42 and 46 secured within openings 44 and 48, respectively, cap 30 presents three protruding ridges 56, 57 and 58 opposing platforms 36–38, respectively. Ridges 56–58 are provided with extending lengths such that when cap 30 is inserted onto the apparatus covering opening 32, the spacing between the ridges 56–58 and the platforms 36–38 is slightly less than the diameter of a twisted pair cable 300 to be received by the apparatus. Accordingly, the ridges and platforms provide means for securing the twisted pair cable to second end 14 by placing the cable 300 on top of platforms 36–38 and extending it through semi-circular opening 34 in end wall 15. By urging cap 30 into position with barbs 42 and 46 received within openings 44 and notches 48, the twisted pair cable 300 is forced to lie in a curved path alternating in height between platforms 36–38 and exiting through opening 34. As a result, the twisted pair cable is securely received within second end 14 due to the crimping action of the opposing and cooperating ridges and platforms thereby abating dislodgement of the twisted pair cable 300 through any tugging action on the cable tending to urge it out of openings 34.

Figure 3:
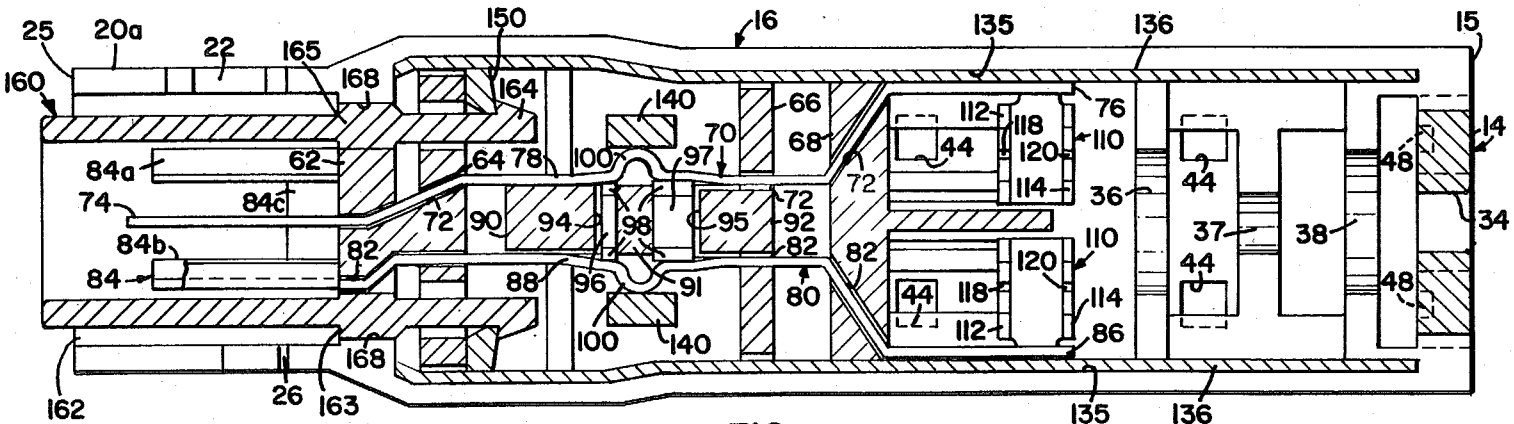
FIG. 3 is a view of FIG. 2 taken along lines III—III.
Figure 4:
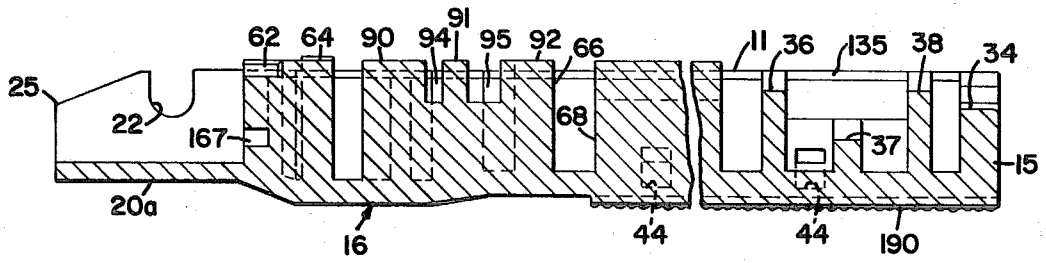
FIG. 4 is a view taken along line IV—IV of FIG. 1.
Figure 7:
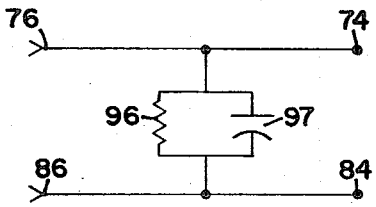
FIG. 7 is a schematic representation of the electrical circuitry of the apparatus of the present invention.

Having described the means for releasably connecting the terminal end 200 to the first end 12 of the apparatus 10 and a twisted pair cable 300 to the second end 14 of the apparatus 10, the electrical connection circuitry of the apparatus 10 of the present invention will now be described. With particular reference to FIG. 3, first and second intermediate electrical connectors 70 and 80 are provided. Each of intermediate connectors 70 and 80 are formed of resilient electrical conductive material. A plurality of axial walls 62, 64, 66 and 68 are formed within housing components 16. A first plurality of channels 72 are formed in each of walls 62, 64, 66 and 68 and aligned to receive first intermediate connector 70 in predetermined fixed alignment with a first end 74 of intermediate connector 70 axially extending through sleeve 20 as an axially extending pin or rod. So aligned, first end 74 is disposed to penetrate the hollow insulating cylinder 204 of the terminal end 200 and effect electrical connection between first end 74 and the terminal end's first exposed electrical contact 206 when the terminal end is received on first end 12 with posts 202 captured within pockets 22.

First intermediate connector 70 terminates at a second end 76 within the area of first housing component 16 exposed by opening 32 when cap 30 is removed. Similarly, walls 62, 64, 66 and 68 are provided with a second plurality of channels 82 disposed to hold second intermediate connector 80 in a predetermined fixed position with first intermediate connector 80 having a first end 84 disposed within sleeve 20 and a second end 86 disposed within the area of first housing component 16 exposed by opening 32 when cap 30 is not in place. First end 84 of second intermediate contact 80 comprises a pair of arcuate contacts 84a and **84*b* joined by a bridge 84c in electrical connection (shown best in FIGS. 11–13). Arcuate contacts 84*a* and 84*b* are disposed on diametrically opposed sides of pin end 74 and are aligned to receive the second exposed contacts 208 of the terminal end 200 when the terminal end is connected to apparatus 10 with the terminal end posts 202 received in pockets 22**.

Shown best in FIG. 3, first and second intermediate connectors 70 and 80 are provided with central portions 78 and 88, respectively, which are aligned in generally parallel spaced apart alignment and separated by three columns 90, 91 and 92. Columns 90–92 project upwardly from housing component 16 and are arranged in spaced apart axial alignment to define two cavities 94 and 95 sized to receive electrical circuit components 96 and 97.

Figure 5:
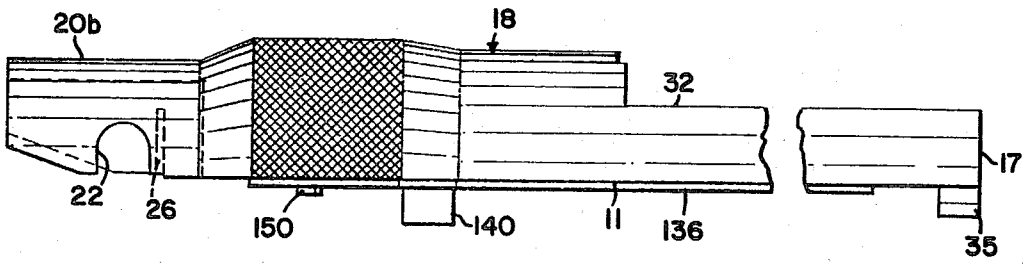
FIG. 5 is a side elevation view of a top housing component of the present invention.
Figure 6:
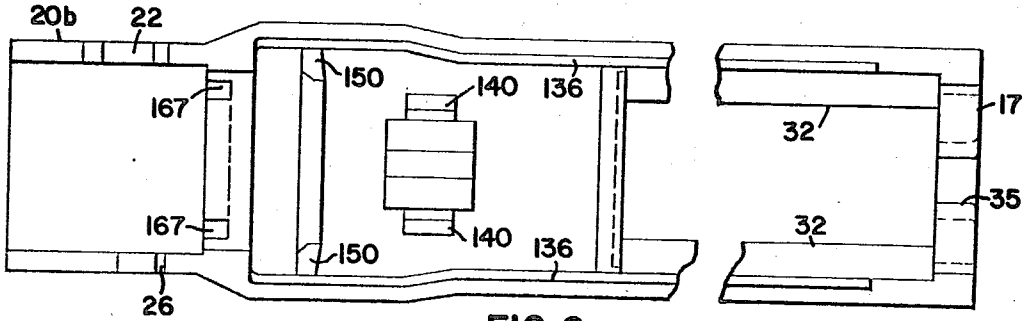
FIG. 6 is a bottom plan view of the component of FIG. 5.

Circuit components 96 and 97 provide for an electrical circuit connecting first and second intermediate connectors 70 and 80. Preferably, component 96 is a resistor and component 97 is a capacitor to provide a circuit such as that schematically shown in FIG. 5. As a result of the circuit in FIG. 5, the resistor 96 and capacitor 97 provide a circuit with the resistor and capacitor connected in parallel across connectors 70 and 80. Resistor 96 and capacitor 97 are preferably of the surface mount type of electrical components which have generally rectangular configuration of uniform size and include electrical contact points 98 opposing the central portions 78 and 88 of the first and second intermediate connectors 70 and 80. As shown in FIG. 3, each of the intermediate connectors 70 and 80 have outwardly protruding bulges 100 to insure sound electrical connection between the contacts 98 and portions 78 and 88 of the intermediate electrical connectors 70 and 80. In a preferred embodiment, where the apparatus 10 is to connect the twisted pair cable 300 to a jack as shown in U.S. patent application Ser. No. 668,752, it is anticipated the jack will be part of a circuit having an impedence different from that of twisted pair cable 300. Circuit elements 96 and 97 are selected to have valves (as is known in the art) to assist in impedance matching between the jack circuit and the cable 300.

Each of second ends 76 and 86 of intermediate connectors 79 and 80, respectively, are provided with means 110 for effecting electrical connection between the second ends 76 and 86 and insulation clad electrical conductors from the twisted pair cable. Each of the means 110 of ends 76 and 86 are identical and a description of one will suffice as a description of both with like parts being identically numbered. Connecting means 110 include parallel aligned spaced apart electrically conductive plates 112 and 114 joined by a common base plate 116 which is in turn fixed to the second ends 76, 86 of the connector 70, 80. Parallel spaced apart plates 112 and 114 are provided with aligned slots 118 and 120, respectively. Slots 118 and 120 have their openings exposed when cap 30 is removed. Edges of plate 112 defining slot 118 are knife-shaped and spaced apart a distance sufficient for the edges to pierce the insulation of the insulation clad conductors 301, 302 of the twisted pair cable 300 and contact the conductors in electrical connection. Such connectors such as plate 112 with slot 118 are referred to as insulation displacement connectors. Slot 120 is sized such that the slot defining edges of plate 114 are spaced apart slightly less than the diameter of the insulation clad conductors of the twisted pair cable. Accordingly, when an insulation clad conductor is inserted within slots 118 and 120, the edges of plate 112 pierce the insulation and provide electrical contact with the conductor. Simultaneously, the edges of plate 114 defining slot 120 pinch the insulation without piercing it and hold the wire extending from plate 112 to plate 114 in generally fixed alignment to avoid cold working of the conductor at slot 118 and to provide a strain relief.

To insert the twisted pair cable wires within the second ends 76 and 86, the wires are laid across slots 118 and 120 and received within the enlarged groove portions 122. Cap 30 is provided with a plunger 124 sized to have a width approximately equal to the width between ends 76 and 86 and a length sized to received between plates 112 and 114 and aligned to be so received as barbs 42 and 46 are received within openings 44 and notches 48, respectively. Plunger 124 is sized to have a depth such that the plunger will urge the wires placed across the slots to urge the wires into the slots and force the insulation displacement connection as cap 30 is inserted covering opening 32. Side plungers 123 and 125 are provided on cap 30 on opposite sides of plunger 124 and aligned to urge a conductor 301, 302 downwardly on exterior sides of plates 112, 114, respectively, as cap 30 is inserted. Accordingly, cap 30 forms simultaneous functions of providing for the insulation displacement of the conductors within slots 118 and also provides the crimp strain relief of the cable 300 on top of platforms 36–38.

Figure 1:
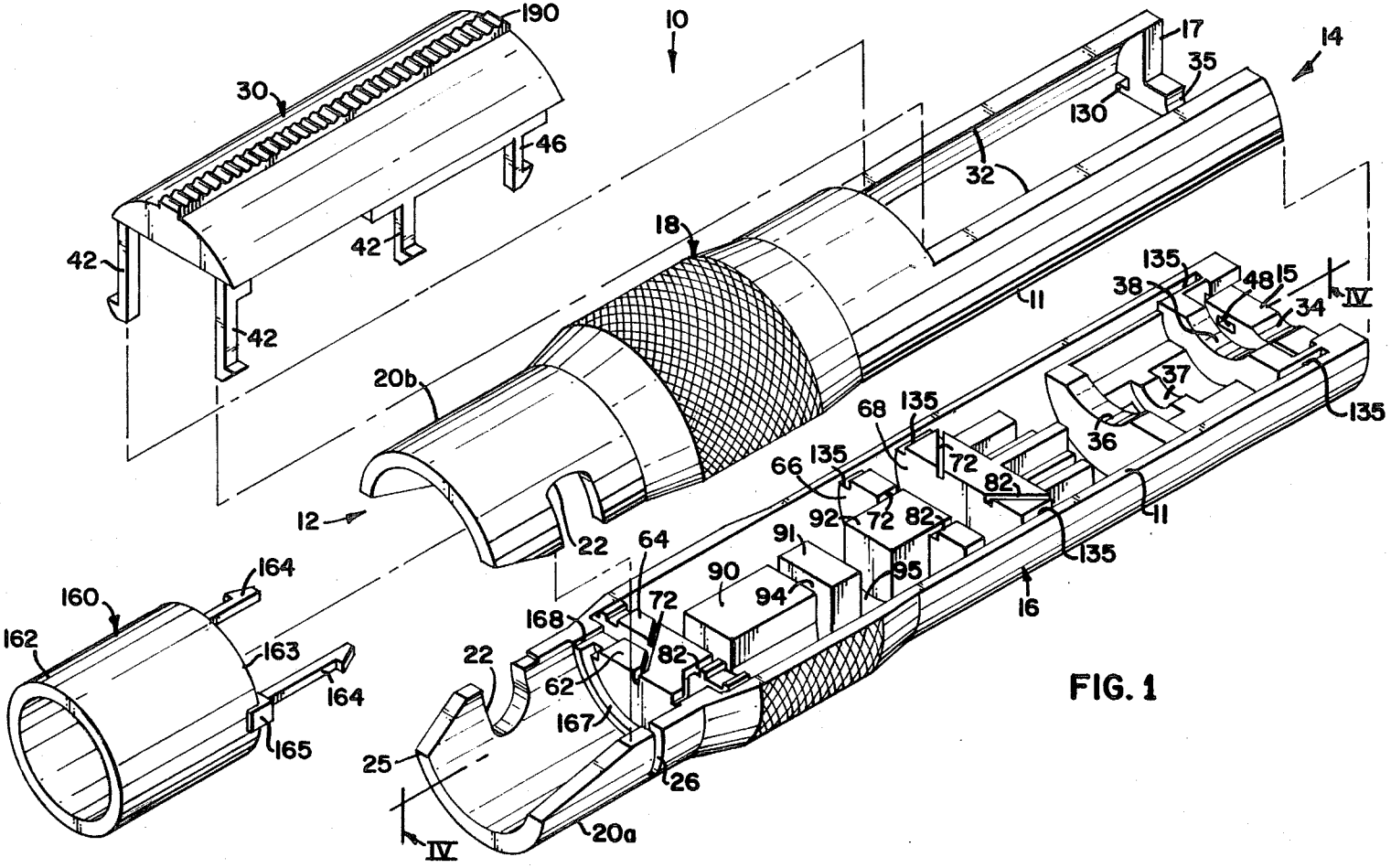
FIG. 1 is an exploded perspective view of a housing for an electrical connector apparatus according to the present invention.

To connect upper housing component 18 with lower housing component 16, several structures are provided. For example, as shown in FIG. 1, rear wall 17 of upper housing component 18 is provided with a protruding tab 130 sized to be received within an aligned slot 132 formed on the rear wall 15 of lower housing component 16 to secure wall 16 in proper alignment with wall 15. Shown in FIGS. 1, 3–6, lower housing component 16 is provided with formed notches 135 extending along opposite sides of component 16 at part line 11 and sized to receive a downwardly protruding elongated bridge 136 extending from both sides of the upper housing component 18 to prevent relative lateral movement of the upper housing component 18 and lower housing component 16. The upper housing component 18 is also provided with a second pair of posts 150 which protrude within housing component 16 and are disposed adjacent wall 64 on a side thereof opposite end 12.

The upper housing component 18 is provided with a pair of spaced apart extending posts 140 disposed with cam surfaces to engage bulge portions 100 of first and second intermediate connectors 70 and 80. As components 16 and 18 are joined, posts 140 urge the bulge portions 100 toward one another to insure good electrical connection between contact points 98 of circuit elements 96 and 97 with the conductive surfaces of central portions 78 and 88 of the intermediate connectors. (As an alternative to post 140, the central portions 78 and 88 could be provided with inwardly protruding surfaces which would act as springs urging the portions 78 and 88 against the contact points 90).

To prevent relative radial movement of components 18 and 16 at first end 12, a cylindrical barrell element 160 is provided having a hollow cylindrical sleeve 162 and a pair of diametrically opposed barbs 164 projecting axially away from first end 163 of sleeve 162. At first end 163, the barbs 164 are provided with alignment plugs 165 which are generally square in cross section. When housing components 18 and 16 are joined, walls 64 of component 16 and opposing wall 64a of housing component 18 define a completed wall having a concentric groove 167 with diametrically opposed passages 168 which are square in cross section and sized to receive plugs 165. With upper housing component 18 and lower housing component 16 joined together, barrel 160 is inserted by passing barbs 164 through openings 168 until plugs 165 are received within openings 168 and the first end 163 of the cylindrical sleeve 162 is received within circular groove 167. At this point, the barbs 164 have passed post 150 and latched on the rearward sides thereof urging posts 150 against fixed wall 64. First end 163 of sleeve 162 received within circular groove 167 prevents relative radial movement of the components 16 and 18.

Sleeve 162 also provides means for breaking electrical connection between the arms **208*a* of the second exposed contacts 208 of the terminal end 200 from the inner surface of the outer cylinder 201 of the terminal end. Specifically, sleeve 162 is sized to be slidably received against the inner surface of the metal cylinder 201 of the terminal end 200 and urge the arms 208*a* away from the cylinder 201. Also, as the terminal end 200 is inserted, the second exposed contacts 208 are received in electrical connection with contacts 84*a* and 84*b***.

Finally, the cap 130 and the diametrically opposed surface of housing component 16 are provided with serrated surfaces 190 to facilitate easy gripping of the apparatus 10 by an operator.

From the foregoing, it has been shown how the objects of the invention have been achieved in a preferred embodiment. Specifically, the invention provides for the novel use of surface mount circuit elements 96 and 97 by using these elements in a heretofore unknown environment to provide electrical circuitry between first and second intermediate connectors 70 and 80. With the connectors 70 and 80 and the circuit elements 96 and 97 placed within housing component 16, a twisted pair cable can be easily installed by an operator by placing the cable on top of platforms 36–38 and extending the cable insulation clad conductors on top of and across slots 118 and 120 of the insulation displacement connectors 110. With the cable and its conductors so installed, cap 130 is inserted with the plunger 124 effecting electrical connection between the insulation clad conductors and the insulation displacement connectors 110 and with the opposing ridges 56–58 and platforms 36-38 providing a crimp connection of the cable 300 to the apparatus 10.

When housing 16 and 18 are joined, posts 140 insure sound electrical connection between the first and second intermediate connectors 70 and 80 and the circuit components 96 and 97. With components 16, 18, 70, 80, 96, 97 and 30 so installed, barrell 160 is inserted with barbs 164 capturing posts 150 against wall 64 and with first end 163 of sleeve 162 captured within cylindrical groove 167. Now fully assembled, the apparatus 10 can be readily connected to the terminal end 200 by urging the terminal end posts 202 within groove 24 with the posts 202 urging flap 27 away so that the posts may be securely received within pocket 22. FIGS. 17 and 18 show a terminal end 200 and the apparatus 10 in unconnected and connected positions respectively. So received, the posts and pockets cooperated to hold the apparatus 10 and the terminal end 200 in predetermined alignment.

Sleeve 162 also breaks the electrical connection between the outer metal sleeve 201 of the terminal end 200 and the second exposed contacts 208 by urging arms **208*a* away from sleeve 201. The second exposed contacts 208 are now in electrical contact with the first end 84 of intermediate connector 80 in electrical communication. Simultaneously, pin end 74 of intermediate connector 70 is received within the hollow insulative cylinder 204 of the terminal end to effect electrical communication between the first intermediate connector 70 and the first exposed contact 206 of the terminal end 200. As a result of the novel apparatus 10 and its method of use as described, an extremely quick and inexpensive electrical connection can be made between a twisted pair cable and jack terminal end with the circuitry of the apparatus 10** providing desired circuitry to compliment the connection of the cable and the jack.

From the foregoing detailed description of the present invention, it has been shown how the objects of the invention have been attained in a preferred manner. However, modifications and equivalents of the disclosed concepts, such as readily occur to those skilled in the art, are intended to be included in the scope of this invention. Thus, the scope of this invention is intended to be limited only by the scope of the claims as are, or may hereafter be, appended hereto.

What is claimed is:

1. An electrical connector apparatus for electrically connecting a twisted pair cable (300) and a terminal end (200) of a jack where the end (200) has a first exposed electrical contact (206) and a second exposed electrical contact (208) and said twisted pair cable (300) includes a first conductor (301) and a second conductor (302), said apparatus comprising:

a housing having a first end (12) for releasably receiving said terminal end (200) and a second end (14) for receiving said first and second conductors (301, 302) of said twisted pair cable (300);

connecting means (20) for releasably connecting said terminal end (200) to said housing first end (12) with said terminal end (200) and said housing first end (12) maintained in predetermined alignment;

a first intermediate electrical connector (70) carried by said housing and having a first end (74) disposed to contact said first exposed electrical contact (206) in electrical connection when said terminal end (200) is connected to said housing by said connecting means (20), means (110) for connecting said first twisted pair cable conductor (301) to said first intermediate electrical connector (70) in electrical connection; and a second intermediate electrical connector (80) carried by said housing and having a first end (84) disposed to contact said second exposed contact (208) in electrical connection when said terminal end (200) is connected to said housing first end (12) by said connecting means (20), means (110) for connecting said second twisted pair cable conductor (302) to said second intermediate electrical connector (80) in electrical connection.

2. An apparatus according to claim 1 wherein said first and second conductors (301, 302) are carried in a common cable (300) and second strain relief means (30) for securing said common cable (300) to said housing second and in fixed alignment therewith.

3. An apparatus according to claim 1 wherein said terminal end (200) includes an exposed cylindrical portion (201) having a radially protruding post (202), said connecting means (20) including a sleeve on said housing first end (12) having a cylindrical inner surface sized to slidably receive said exposed cylindrical portion (201);

a pocket (22) formed in said sleeve (20) sized and positioned to receive said post (202) when said terminal end (200) and housing first end (12) are in predetermined alignment;

an axial slit (24) formed in said sleeve (20) and extending from a free end (12) thereof and past said pocket (22), said axial slit (24) disposed in communication with said pocket, said axial slit dimensioned at said free end to receive said post (202) within said slit and being reduced in dimension to a location (27) adjacent said pocket with said slit smaller than said post; and a circumferential slit (26) formed in said sleeve (20) and extending from a point on said slit (24) on a side opposite said pocket (22) in a direction away from said pocket.

4. An apparatus according to claim 1 comprising circuit means (96, 97) for establishing an electrical circuit between said first and second intermediate electrical connectors (70, 80).

5. An apparatus according to claim 4 wherein said circuit means includes a plurality of circuit elements (96, 97) disposed within said housing with each of said circuit elements having first and second electrical contact points (98) with said first contact points disposed to be in electrical connection with said first intermediate connector (70) and said second contact points to be in electrical connection with said second intermediate connector (80).

6. An apparatus according to claim 5 wherein said circuit elements (96, 97) comprise surface mount circuit components having said first and second contact points with said first points disposed opposing said first intermediate connector and said second points disposed opposing said second intermediate connectors;

means (100, 140) for urging said first intermediate connector (70) into electrical contact with said first points; and means (100, 140) for urging said second intermediate connector (80) into electrical contact with said second points.

7. An apparatus according to claim 1 wherein said first and second intermediate connectors (70, 80) are each provided with second ends (76, 86) having insulation displacement connector means (110) for receiving insulation clad conductors (301, 302) and piercing said insulation and contacting said conductors in electrical connection as said conductors are connected to said second ends, said insulation displacement connector means (110) comprising said means for connecting said first and second conductors to said first and second intermediate connectors.

8. An apparatus according to claim 7 comprising first strain relief means for (120) retaining said first and second conductors in fixed alignment adjacent said insulation displacement connector means.

9. An electrical connector apparatus for electrically connecting a twisted pair cable with a jack where said jack has a terminal end (200) with a first exposed electrical contact (206) and a second exposed electrical contact (208) disposed in predetermined alignment and said cable (300) includes a first conductor (301) and a second conductor (302), said apparatus comprising;

a housing having a first end (12) for releasably receiving said terminal end (200) and a second end (14) for receiving said twisted pair cable (300), said housing being split along a longitudinal axis between said first and second end and to a first housing component (16) and a second housing component (18);

connecting means (20) for releasably connecting said terminal end (200) to said first end (12) in predetermined alignment;

said first housing component (16) having means for aligning a first intermediate connector (70) and second intermediate connector (80) in predetermined fixed positions with said first and second intermediate connectors (70, 80) being disposed with first ends (74, 84) to contact said first and second exposed contacts (206, 208), respectively, of said terminal end (200) when said terminal end (200) is connected to said first housing end (12) by connecting means (20); and with said first and second intermediate connectors having opposing spaced apart circuit element contact portions (78, 88) when in said fixed positions;

a plurality of circuit elements (96, 97) disposed within said housing with means for holding said circuit elements between said first and second intermediate connectors and in contact therewith to provide an electrical circuit between said first and second intermediate connectors; said first and second intermediate connectors (70, 80) having second ends (76, 86) with insulation displacement connector means (110) for electrically connecting said second ends to electrical conductors of said twisted pair cable; and means for joining said first and second housing components.

10. An apparatus according to claim 9 comprising means (32) within said second housing component (18) for exposing said second ends (76, 86) of said intermediate connectors (70, 80) and said cable (300); and means (32) for closing said exposure (32) and urging said conductors into said insulation displacement connector means.

11. An apparatus according to claim 9 wherein said terminal end (200) includes a first hollow portion (201) having an inner cylindrical surface with said second contact (208) having a portion (**208*a*) being resiliently bias to engage said cylindrical surface, said apparatus (10) further comprising separating means (160) disposed on said first end (12) having an outer cylindrical surface coaxially aligned with said inner cylindrical surface of said portion (201) when said terminal end (200) and said first end (12) are connected by said connecting means (20); said means (160) being sized to be received within said hollow portion (201) to urge said portions (208*a***) away from said inner cylindrical surface.

12. An apparatus according to claim 11 wherein said separating means (160) includes fastening means (164) for fastening said first housing component to said second housing component.

13. A connection apparatus for establishing connection to a terminal end (200) of a jack wherein said terminal end (200) includes an exposed cylindrical portion (201) having a radially protruding post (202), said connection apparatus comprising:

a sleeve (20) having a cylindrical inner surface sized to slidably receive said exposed cylindrical portion (201);

a pocket (22) formed in said sleeve (20) sized and positioned to receive said post (202) when said terminal end (200) and housing first end (12) are in predetermined alignment;

an axial split (24) formed in said sleeve (20) and extending from a free end (12) thereof and past said pocket (22), said axial slit (24) disposed in communication with said pocket, said axial slit dimensioned at said free end to receive said post (202) within said slit and being reduced in dimension to a location (27) adjacent said pocket with said slit smaller than said post; and a circumferential slit (26) formed in said sleeve (20) and extending from a point on said slit (24) on a side opposite said pocket (22) in a direction away from said pocket.

* * * * *

UNITED STATES PATENT AND TRADEMARK OFFICE

CERTIFICATE OF CORRECTION

PATENT NO. : 4,693,537

DATED : September 15, 1987

INVENTOR(S) : Jeffrey Dinsmore

It is certified that error appears in the above-identified patent and that said Letters Patent is hereby corrected as shown below:

Column 3, line 29, "a end" should be --an end--;

Column 4, line 1, "dimetrically" should be --diametrically--;

Column 4, line 49, "an corresponding" should be --a corresponding--;

Column 6, line 35, "impedence" should be --impedance--;

Column 6, line 40, "79" should be --70--;

Column 7, line 9 "to received" should be --to be received--;

Column 7, line 57 "barrell" should be --barrel--;

Column 8, line 50 "barrell" should be --barrel--;

Column 12, line 27, "split" should be --slit--.

Signed and Sealed this

Twenty-sixth Day of January, 1988

*Attest:*

DONALD J. QUIGG

*Attesting Officer*

*Commissioner of Patents and Trademarks*